US005813924A

United States Patent [19]

Yamagishi et al.

[11] Patent Number: 5,813,924

[45] Date of Patent: Sep. 29, 1998

[54] GOLF BALL

[75] Inventors: Hisashi Yamagishi; Yoshinori Egashira; Hideo Watanabe; Atuki Kasasima, all of Chichibu, Japan

[73] Assignee: Bridgestone Sports Co., Ltd., Tokyo, Japan

[21] Appl. No.: 878,062

[22] Filed: Jun. 18, 1997

Related U.S. Application Data

[63] Continuation-in-part of Ser. No. 536,049, Sep. 29, 1995, Pat. No. 5,743,817.

[30] Foreign Application Priority Data

Oct. 14, 1994 [JP] Japan ..... 6-276109
Dec. 14, 1994 [JP] Japan ..... 6-333024

[51] Int. Cl.[6] ..... A63B 37/06; A63B 37/12; A63B 37/14

[52] U.S. Cl. ..... 473/377; 473/384; 473/372

[58] Field of Search ..... 473/377, 383, 473/384, 378, 372, 373, 374, 351, 385; 273/DIG. 22

[56] References Cited

U.S. PATENT DOCUMENTS 4,681,323 7/1987 Alaki et al. ..... 473/384
5,743,817 4/1998 Yamagishi et al. ..... 473/377

*Primary Examiner*—George J. Marlo
*Attorney, Agent, or Firm*—Sughrue, Mion, Zinn, Macpeak & Seas, PLLC

[57] ABSTRACT

There is provided a golf ball comprising a core and a cover having a plurality of dimples thereon wherein said core has a distortion of 2.8 to 4.0 mm under a load of 100 kg, the ratio of a core distortion under a load of 100 kg divided by a ball distortion under a load of 100 kg ranges from 1.0 to 1.3, said cover has a thickness of 1.4 to 1.9 mm, and a Shore D hardness of 53 to 60, said dimples are divided into at least three kinds of dimples which have different diameters each other, each dimple has the ratio of diameter (mm) divided by depth (mm) of 18 to 27, the value of the spatial volume of each dimple below a plane defined by an edge of the dimple divided by the volume of a cylinder wherein the bottom of said cylinder is defined by said plane and the height is determined by the maximum depth of the dimple from said plane ranges from 0.390 to 0.550, and the total number of said dimples is in the range of 390 to 450.

2 Claims, 8 Drawing Sheets

GOLF BALL

CROSS REFERENCE TO RELATED APPLICATION

This application is a continuation-in-part of copending application Ser. No. 08/536,049 filed on Sep. 29, 1995 now Pat. No. 5,743,817, the entire contents of which are hereby incorporated by reference.

BACKGROUND OF THE INVENTION

1. Field of the Invention

This invention relates to a solid golf ball having good flying distance and improved feel and spin performance.

2. Prior Art

As compared with wound golf balls, two-piece golf balls and other solid golf balls are advantageous in gaining a flying distance since they fly along the trajectory of a straight ball when hit by both drivers and irons. This advantage is mainly attributable to their structure. Because of their configuration less receptive to spin, the solid golf balls are given a straight ball trajectory and yield a more run, resulting in an increased total flying distance.

In turn, the solid golf ball tends to draw a "flier" path on an iron shot since it is less receptive to spin and does not readily stop on the green. Because of such characteristics, the two-piece balls are not preferred by experienced players.

Therefore, there is a need for a solid golf ball having improved spin properties and allowing the player to aim the pin dead with an iron. The increased flying distance inherent to the solid golf ball should be maintained and of course, the ball should have a pleasant feel.

SUMMARY OF THE INVENTION

Accordingly, an object of the present invention is to provide a solid golf ball such as a two-piece golf ball which is improved in feel, spin properties and iron control with good flying distance. The term iron control is the controllability of a ball on an iron shot, more specifically stop on the green.

The present invention provides a solid golf ball comprising a solid core and a cover having a plurality of dimples thereon wherein the core has a distortion of 2.8 to 4.0 mm under a load of 100 kg, the ratio of a core distortion (mm) under a load of 100 kg divided by a ball distortion (mm) under a load of 100 kg ranges from 1.0 to 1.3, the cover has a thickness of 1.4 to 1.9 mm, and a Shore D hardness of 53 to 60, said dimples are divided into at least three kinds of dimples which have different diameters each other, each dimple has the ratio of diameter (mm) divided by depth (mm) of 18 to 27, the value of the spatial volume of each dimple below a plane defined by an edge of the dimple divided by the volume of a cylinder wherein the bottom of said cylinder is defined by said plane and the height is determined by the maximum depth of the dimple from said plane ranges from 0.390 to 0.550, and the total number of said dimples is in the range of 390 to 450.

This parameter control leads to a golf ball satisfying the requirements of flying distance, feel and spin.

Consider the spin mechanism of golf balls made of the same materials, but changed in hardness. Provided that the club head speed and the cover material are identical, the coefficient of friction between the ball and the club face is identical and hence, an identical frictional force is exerted therebetween. Only distortion is different due to differential hardness. Then the distance between the center of gravity and the ball-club contact point is different. The harder the ball, the longer is the contact point distance. The softer the ball, the shorter is the contact point distance. Then harder balls are more receptive to spin.

The spinning mechanism associated with an iron suggests that the spin quantity can be increased by increasing the ball hardness. Increasing the ball hardness, however, gives a harder feel, exacerbating the hitting feel. The spin quantity can also be increased by making the cover softer. A softer cover, however, deprives the ball of repulsion, resulting in a loss of initial speed and flying distance.

Attempting to increase the spin quantity for improving spin properties by using a soft material, typically a material having a Shore D hardness of 53 to 60 as the cover, we found that a low hardness cover lowers repulsion, resulting in a loss of flying distance on hitting. Quite unexpectedly, we have found that by adjusting the core distortion of 2.8 to 4.0 mm under a load of 100 kg, the ratio of core distortion (mm) to ball distortion (mm) to range from 1.0 to 1.3 and the cover thickness to range from 1.4 mm to 1.9 mm, and at the same time by forming the dimples so that the dimples are divided into at least three kinds of dimples which have different diameters, each dimple has the ratio of diameter (mm) divided by depth (mm) of 18 to 27, the value of the spatial volume of each dimple below a plane defined by an edge of the dimple divided by the volume of a cylinder wherein the bottom of said cylinder is defined by said plane and the height is determined by the maximum depth of the dimple from said plane ranges from 0.390 to 0.550, and the total number of said dimples is in the range of 390 to 450, the golf ball, whose cover is made of a softer material, is improved in iron control (that is, stop on the green) without deterring the feel and flying distance and without losing the trajectory and flying distance on a driver shot.

DETAILED DESCRIPTION OF THE PREFERRED EMBODIMENTS

Figure 1:
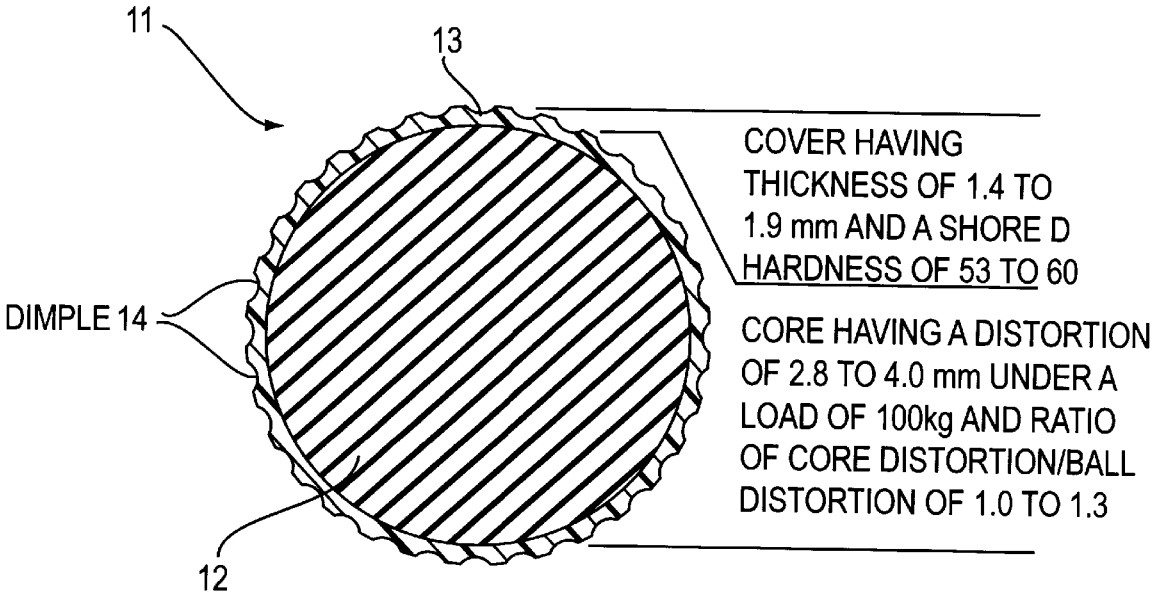
FIG. 1 is a sectional view of one embodiment of a golf ball according to the present invention.

FIG. 1 shows one embodiment of a golf ball 11 according to the present invention which comprises a spherical solid core 12 enclosed in a cover 13 having a plurality of dimples 14 thereon.

In the golf ball according to the present invention, the core distortion under a load of 100 kg is 2.8 to 4.0 mm, the ratio of the core distortion divided by the ball distortion is in the range of 1.0 to 1.3 and the cover has a thickness of 1.4 to 1.9 mm.

The core distortion and ball distortion are defined by distortions (in mm) of the core and ball under a load of 100 kg, respectively. The core distortion corresponds to such a distortion of 2.8 to 4.0 mm, more preferably 3.0 to 4.0 mm. With a core distortion of less than 2.8 mm, the feel becomes unpleasant. Too much core distortions would result in balls having poor restitution, low flying performance and a too soft feel. By controlling the core distortion/ball distortion so as to fall in the range between 1.0 and 1.3, especially between 1.0 and 1.25, the solid golf ball, typically two-piece golf ball is improved in feel, flying distance and spin characteristics. If the core distortion/ball distortion is less than 1.0, the feel becomes unpleasant. If the core distortion/ball distortion exceeds 1.3, the ball loses a quick stop on the green.

It is understood that the golf ball of the present invention is advantageously applied to two-piece golf balls having a single core. It is also applicable to multi-core golf balls having a core consisting of two or more layers, such as three-piece golf balls. In an example where the core consists of two inner and outer layers, the core distortion refers to the distortion of the spherical two-layer core as a whole. Differently stated, the core distortion refers to the distortion of an entire spherical core left after removing the cover from the ball.

The cover has a Shore D hardness of 53 to 60, especially 55 to 60. A cover hardness of more than 60 (Shore D) would adversely affect spin characteristics and stop on the green. Since a cover with too low hardness would result in poor repulsion and a loss of flying distance, the lower limit of 53 (Shore D) is recommended for the cover hardness.

According to the invention, the cover has a radial thickness of 1.4 to 1.9 mm, preferably 1.4 to 1.8 mm. Outside the range, the objects of the invention cannot be achieved. A cover of thinner than 1.4 mm is less resistant against top damage and liable to be broken. A cover of thicker than 1.9 mm leads to losses of repulsion and flying performance and gives a dull feel.

In general, the flying distance depends on the head speed. The flying distance is reduced by a change from a higher head speed to a lower head speed. The degree of reduction of the flying distance by a change from a higher head speed to a lower head speed can be suppressed by limiting the cover thickness to the above-defined range. Differently stated, the dependency of flying distance on head speed is alleviated. Therefore, the ball of the invention is suitable for senior and female players who swing at a relatively low head speed (usually a head speed of about 30 to about 40 m/sec.).

The golf ball of the invention is advantageously applied to two-piece golf balls while it is also applicable to multi-core golf balls such as three-piece golf balls. The material and preparation of the core and cover are not critical. The components may be made of any of well-known materials insofar as the requirements of the invention are met. Of course, the golf ball of the invention has a standard size and weight (usually, a diameter of 42.65 to 42.75 mm and a weight of 45.0 to 45.5 grams).

More particularly, the core of the present solid golf ball is formed from a rubber composition by a conventional method while properly adjusting the component proportion and vulcanizing conditions. The core composition generally includes a base rubber, a crosslinking agent, a co-crosslinking agent, an inert filler, and other components. The base rubber may be selected from natural and synthetic rubbers conventionally used in the manufacture of solid golf balls. Preferably the base rubber is 1,4-polybutadiene rubber containing at least 40% of cis-configuration, optionally in admixture with natural rubber, polyisoprene rubber or styrene-butadiene rubber. The crosslinking agent is preferably selected from organic peroxides such as dicumyl peroxide and di-t-butyl peroxide, with the dicumyl peroxide being more preferred. Preferably the crosslinking agent is blended in an amount of about 0.5 to 3 parts, more preferably about 0.8 to 1.5 parts by weight per 100 parts by weight of the base rubber. Non-limiting examples of the co-crosslinking agent include metal salts of unsaturated fatty acids, especially zinc and magnesium salts of unsaturated fatty acids having 3 to 8 carbon atoms, such as acrylic acid and methacrylic acid. Zinc acrylate is the most preferred salt. The co-crosslinking agent is preferably blended in an amount of about 24 to 38 parts, more preferably about 28 to 34 parts by weight per 100 parts by weight of the base rubber. Examples of the inert filler include zinc oxide, barium sulfate, silica, calcium carbonate, and zinc carbonate, with the zinc oxide being most often used. The amount of the filler blended depends on the desired specific gravity of the core and cover, ball weight, and other factors although it generally ranges from about 10 to about 60 parts by weight per 100 parts by weight of the base rubber.

These components are blended to form a core-forming rubber composition which is kneaded by means of a conventional kneading machine such as a Banbury mixer and roll mill and then compression or injection molded in a spherical mold cavity. The molded composition is cured by heating it at a sufficient temperature for the crosslinking and co-crosslinking agents to exert their function (for example, about 130 to 170° C. when the crosslinking agent is dicumyl peroxide and the co-crosslinking agent is zinc acrylate). In this way, a solid spherical core having a diameter of 38.85 to 39.95 mm is prepared.

In the case of a two layer core, the inner core may be made of the same composition as above and the outer core may be made of a similar rubber composition or a resin composition based on an ionomer resin or the like. The outer core may be formed by compression molding or injection molding it around the inner core. Typically the inner core has a diameter of 27.0 to 38.0 mm, preferably 28.0 to 36.0 mm and the outer core has a diameter of 0.5 to 6.5 mm, preferably 1.5 to 5.5 mm, and the total diameter ranges from 38.85 to 39.95 mm.

The solid core is enclosed with the cover by any desired technique, for example, by enclosing the core in a pair of semi-spherical shell halves followed by heat compression molding. Alternatively the core is directly covered with a cover material by injection molding. By properly selecting the material and amount of the core and cover and preparation conditions such as vulcanizing conditions, a golf ball satisfying the requirements of the invention can be prepared.

The cover may be made of a known material such as an ionomer resin, thermoplastic elastomer and the mixture thereof as a resin component. Preferred is an ionomer resin.

A plurality of dimples are formed on the cover. In the present invention, at least three kinds, preferably three to six kinds, more preferably three to five kinds of dimples are formed. At least three kinds of dimples should have different diameters each other. If only one or two kinds of dimples are formed, the effect of the present invention is not fully exerted.

Each dimple should preferably have a diameter of 2.0 to 4.5 mm, more preferably 3.0 to 4.3 mm, and a depth of 0.07 to 0.28 mm, more preferably 0.09 to 0.25 mm. Desirably, the dimples having the largest diameter have a diameter of 3.6 to 4.5 mm, especially 3.7 to 4.3 mm, and a depth of 0.13 to 0.28 mm, especially 0.15 to 0.25 mm. The dimples having the smallest diameter preferably have a diameter of 2.0 to 3.8 mm, especially 2.2 to 3.6 mm, and a depth of 0.07 to 0.20 mm, especially 0.09 to 0.18 mm. The dimples may have circular shape in plane.

In the present invention, each dimple should have the ratio of diameter (mm) divided by depth (mm) of 18 to 27, preferably 19 to 26, more preferably 20 to 25. If the ratio (diameter/depth) is less than 18, a flying distance would be lowered because of a too high trajectory. If the ratio (diameter/depth) is more than 27, a flying distance would also be lowered because of a dropped trajectory. In this case, each dimple having the largest diameter preferably has the ratio of diameter (mm) divided by depth (mm) of 22 to 26, especially 23 to 25.

Further, in the present invention, the value (referred as $V_0$ herein below) of the spatial volume of each dimple below a plane defined by an edge of the dimple divided by the volume of a cylinder wherein the bottom of said cylinder is defined by said plane and the height is determined by the maximum depth of the dimple from said plane ranges from 0.390 to 0.550, preferably from 0.395 to 0.545, more preferably from 0.400 to 0.540. If $V_0$ is less than 0.390, a flying distance would be lowered because of a dropped trajectory.

It should be noted that how to calculate $V_0$ is disclosed in Alaki et al., U.S. Pat. No. 4,681,323. The content of how to calculate $V_0$ in U.S. Pat. No. 4,681,323 is incorporated herein.

More specifically, the calculation method of $V_0$ is as follows.

Figure 2:
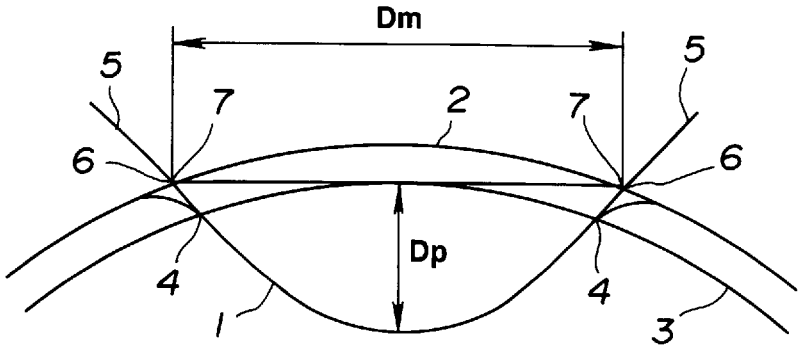
FIGS. 2 to 4 are diagrammatic representations illustrating how to calculate the spatial volume of a dimple and the volume of a cylinder.
Figure 3:
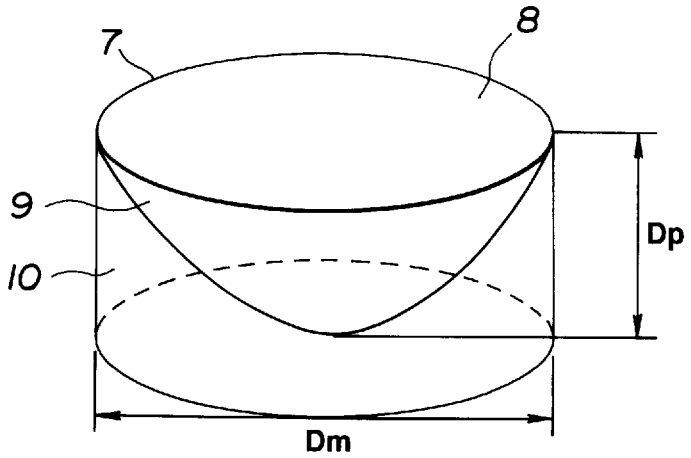
Figure 4:
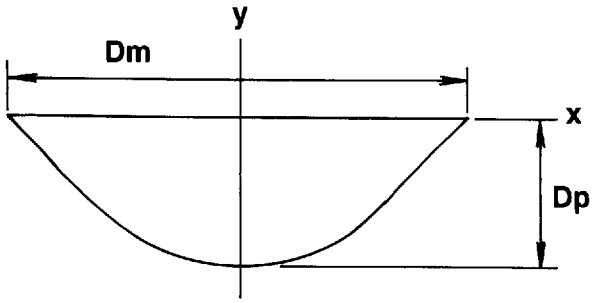

When the shape of a dimple in plan is a circle, an imaginary spherical face 2 of the diameter of the ball is drawn above a dimple 1 as illustrated in FIG. 2 while another spherical face 3 having a smaller diameter by (0.16 mm) than the ball diameter is also drawn, and cross points 4 between the spherical face 3 and the dimple 1 are found. Then, the line of cross points 6 between tangential lines 5 at the cross points 4 and the imaginary spherical face 2 is defined as a dimple edge 7. This definition of the dimple edge 7 is necessary because an accurate position of a dimple edge cannot be found without this definition since a marginal edge of a dimple 1 is normally a little rounded. Then, the first volume ($V_1$) of the dimple space 9 below the plane (a circle: a diameter Dm) 8 surrounded by the dimple edge 7 as illustrated in FIGS. 3 and 4 is calculated by the following equation.

$$V_1 = \int_0^{\frac{dm}{2}} 2\pi xy dx$$

Meanwhile, the volume $V_2$ of the cylinder 10 wherein the bottom thereof is defined by the plane 8 and the height is defined by the maximum dimple depth Dp from the plane 8 is calculated by the following equation:

$$V_2 = \frac{\pi Dm^2 Dp}{4}$$

Then, the ratio $V_0$ of the dimple volume $V_1$, to the cylinder volume $V_2$ is calculated by the following equation:

$$V_0 = V_1/V_2$$

It is to be noted that when the shape of the dimple from a plan view is not a circle, the diameter is defined as a diameter whose area of circle is equal to that of the shape which is not a circle, so that $V_0$ is calculated in the same manner as described above.

The total number of the dimples is in the range of 390 to 450, preferably 392 to 440. In this case, the number of the dimples having the largest diameter should preferably occupy at least 10%, preferably 10 to 50%, more preferably 15 to 40%, most preferably 17 to 30% in the total number of all the dimples. The number of the dimples having the smallest diameter preferably occupies 5 to 40%, more preferably 10 to 35%. The other dimples preferably occupy 5 to 80%, more preferably 10 to 70%.

The dimple distribution may be done according to known methods.

There has been described a golf ball which is improved in feel and spin characteristics and has good flying distance. The golf ball of the present invention undergoes a lower degree of reduction of its flying distance upon hitting at a lower head speed.

EXAMPLE

Examples of the present invention are given below by way of illustration and not by way of limitation.

Examples 1–6 and Comparative Examples 1–2

Cores having a distortion under a load of 100 kg as shown in Table 1 were molded by vulcanizing in a mold rubber compositions comprising cis-1,4-polybutadiene rubber, zinc acrylate, zinc oxide, and dicumyl peroxide. The core distortion reported is a distortion in millimeter under a load of 100 kilograms.

The cores were enclosed with covers which were formed from mixtures of ionomer resins. The blending proportion of ionomer resins was changed to form covers having varying hardness (Shore D scale) as shown in Table 2. In this way, there were obtained large-size two-piece golf balls having a distortion as shown in Table 3. The ball distortion reported is again a distortion in millimeter under a load of 100 kilograms.

The base composition for the core consisted of the following components.

| | Parts by weight |
|---|---|
| cis-1,4-polybutadiene rubber (BR01) | 100 |
| zinc acrylate | shown in Table 1 |
| zinc oxide | 10 |
| barium sulfate | shown in Table 1 |
| anti-oxidant | 0.2 |
| dicumyl peroxide | 0.9 |

Cores having varying hardness and specific gravity were obtained by varying the amounts of zinc acrylate and barium sulfate as shown in Table 1.

TABLE 1

| | Distortion (mm) | Cover thickness (mm) | Zinc acrylate (parts by weight) | Barium sulfate (parts by weight) |
|---|---|---|---|---|
| Example 1 | 2.95 | 1.50 | 30 | 8.7 |
| Exarnple 2 | 3.30 | 1.50 | 28 | 9.6 |
| Example 3 | 3.60 | 1.80 | 26 | 12 |
| Example 4 | 3.90 | 1.50 | 22 | 12.5 |
| Exarnple 5 | 3.95 | 1.90 | 23 | 13.5 |
| Comparative Example 1 | 2.60 | 2.00 | 33 | 9.7 |
| Comparative Example 2 | 3.00 | 1.40 | 30 | 8.2 |
| Comparative Example 3 | 2.90 | 2.40 | 31 | 13.9 |
| Comparative Example 4 | 3.00 | 1.90 | 30 | 10.9 |
| Comparative Example 5 | 4.00 | 1.80 | 22 | 13.6 |

The base composition for the cover was a 40/60 or 50/50 (by weight) mixture of ionomer resins Himilan and Surlyn.

Covers having varying hardness were obtained while blending Himilan and Surlyn in a ratio as shown in Table 2.

TABLE 2

| Cover Resin (parts by weight) | I | II | III | IV |
|---|---|---|---|---|
| Himilan 1650 | 40 | | | |
| Surlyn 8120 | 60 | | | |
| Himilan 1557 | | 50 | | |
| Himilan 1601 | | 50 | 50 | |
| Himilan 1705 | | | 50 | |
| Himilan 1605 | | | | 50 |
| Himilan 1706 | | | | 50 |
| Cover hardness (Shore D) | 56 | 57 | 60 | 65 |

*Himilan commercially available from du Pont-Mitsui Polychemical Co., Ltd.
Surlyn commercially available from E. I. duPont The dimples having the parameters shown in Table 3 were formed on the cover.

TABLE 3

Figure 5:
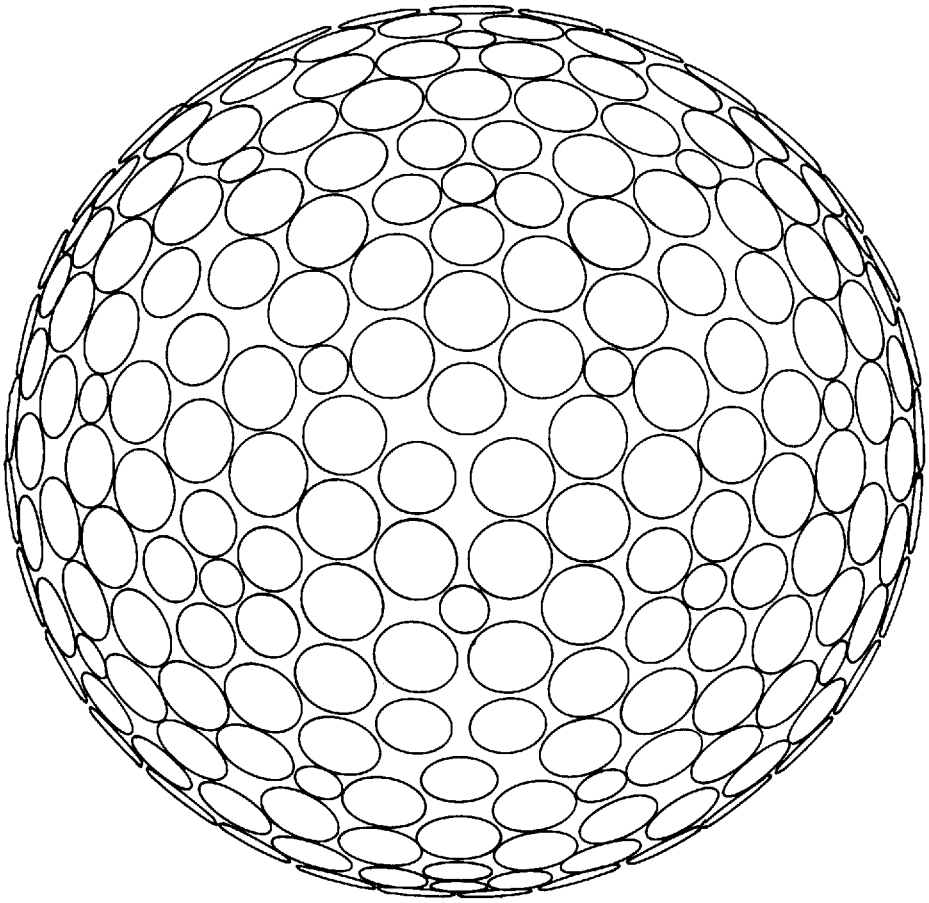
FIG. 5 is a plain view of the first embodiment of dimple distribution.
Figure 6:
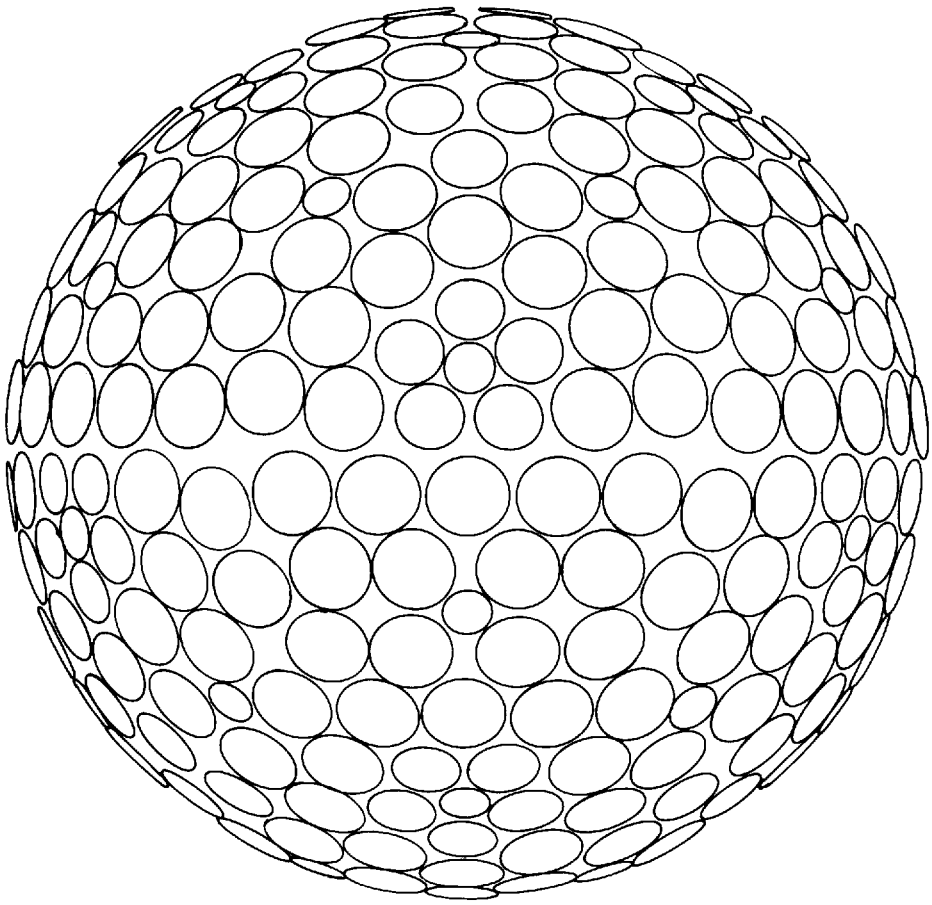
FIG. 6 is a front view of the first embodiment of dimple distribution.

| Dimple mode | Diameter (mm) | Depth (mm) | $V_0$ | Number | Diameter/ Depth | |
|---|---|---|---|---|---|---|
| A | 3.950 | 0.174 | 0.485 | 276 | 22.7 | FIGS. 5, 6 |
| | 3.610 | 0.153 | 0.492 | 24 | 23.6 | |

TABLE 3-continued

Figure 7:
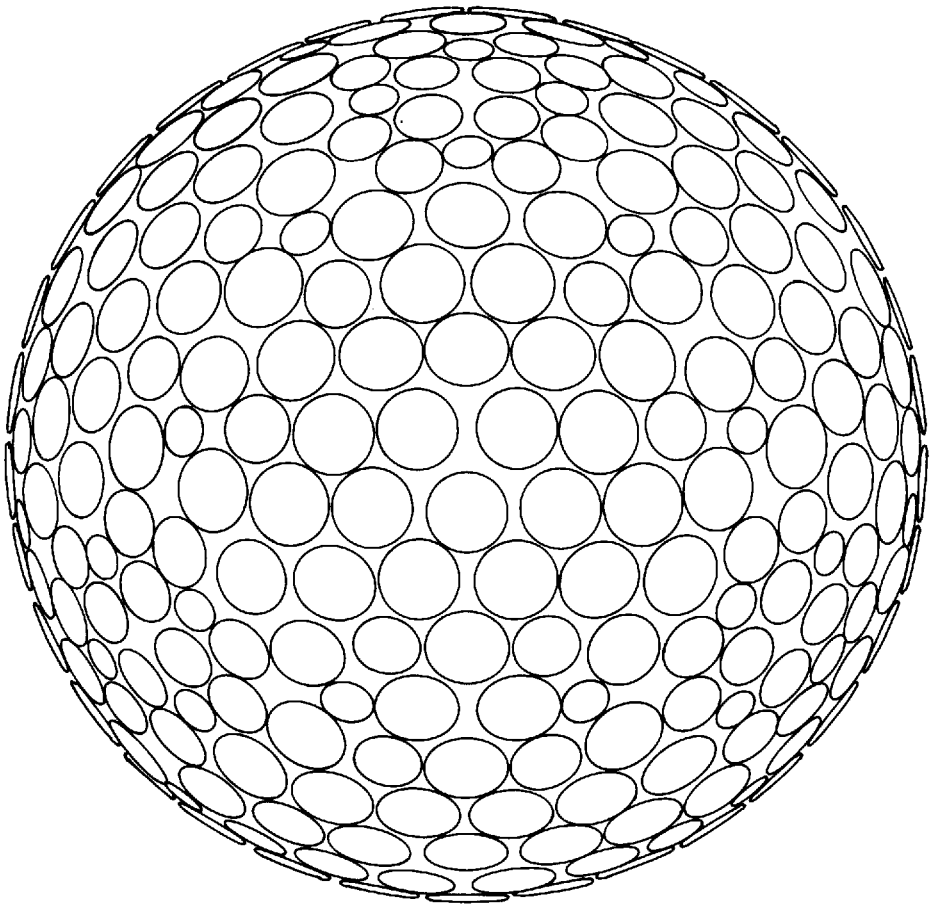
FIG. 7 is a plain view of the second embodiment of dimple distribution.
Figure 8:
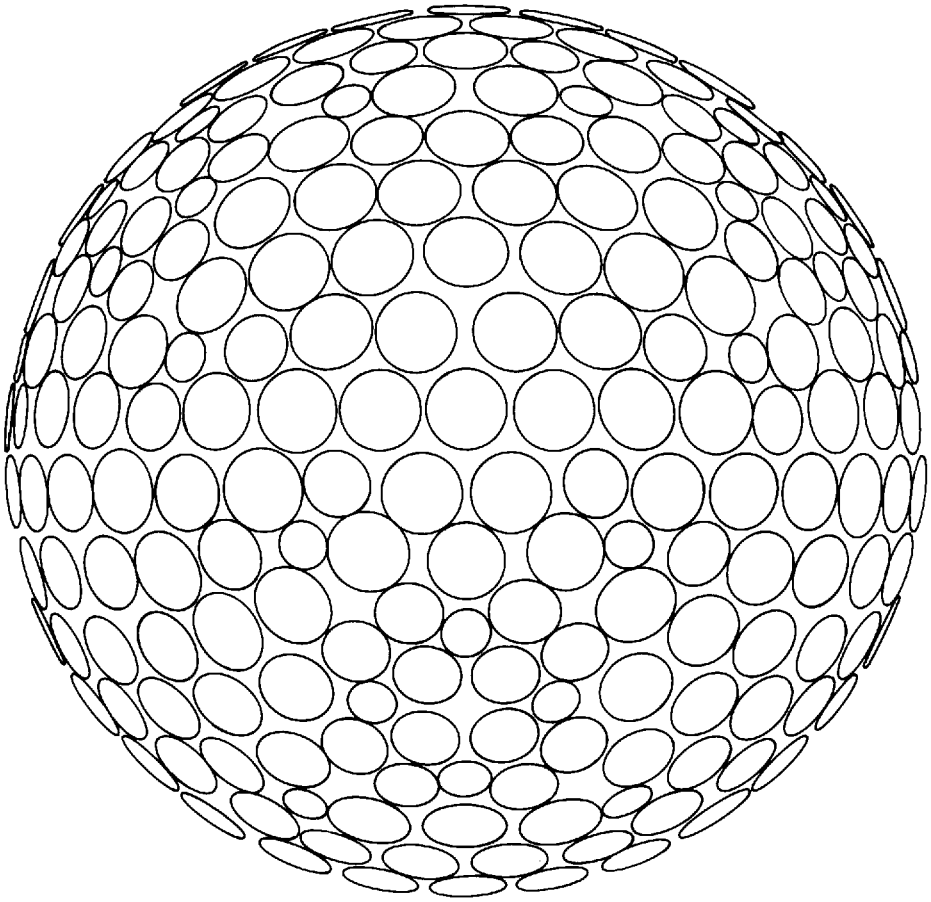
FIG. 8 is a front view of the second embodiment of dimple distribution.
Figure 9:
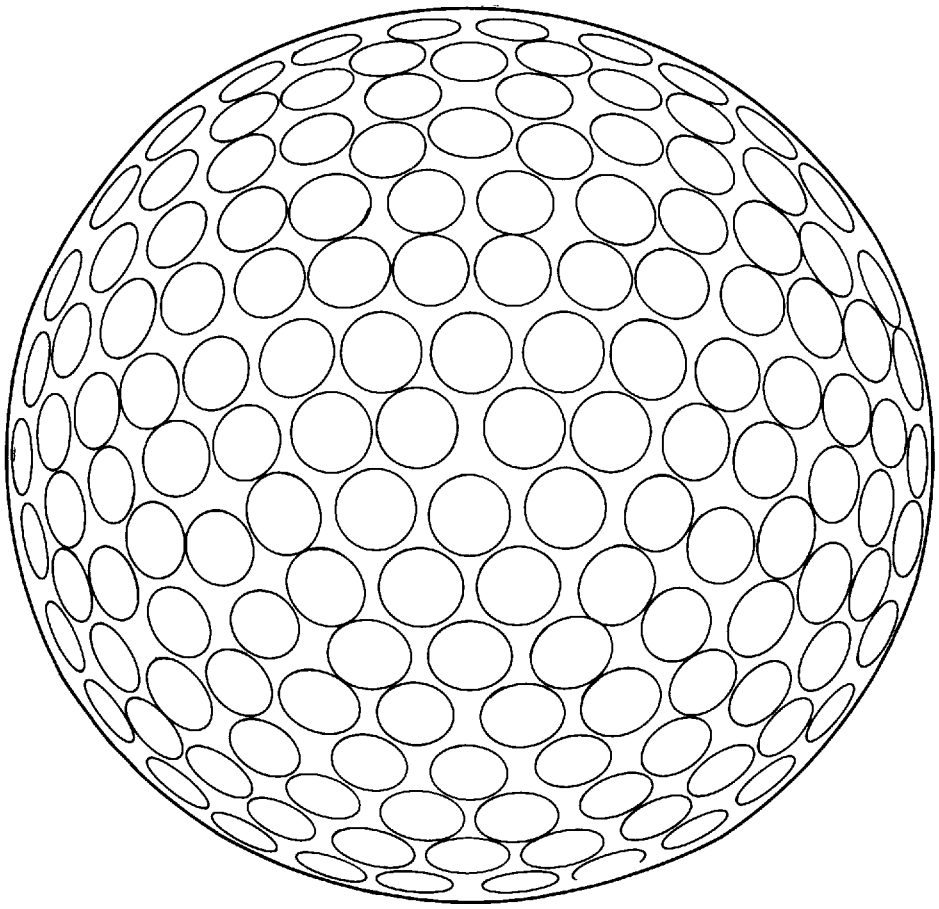
FIG. 9 is a plain view of the third embodiment of dimple distribution.
Figure 10:
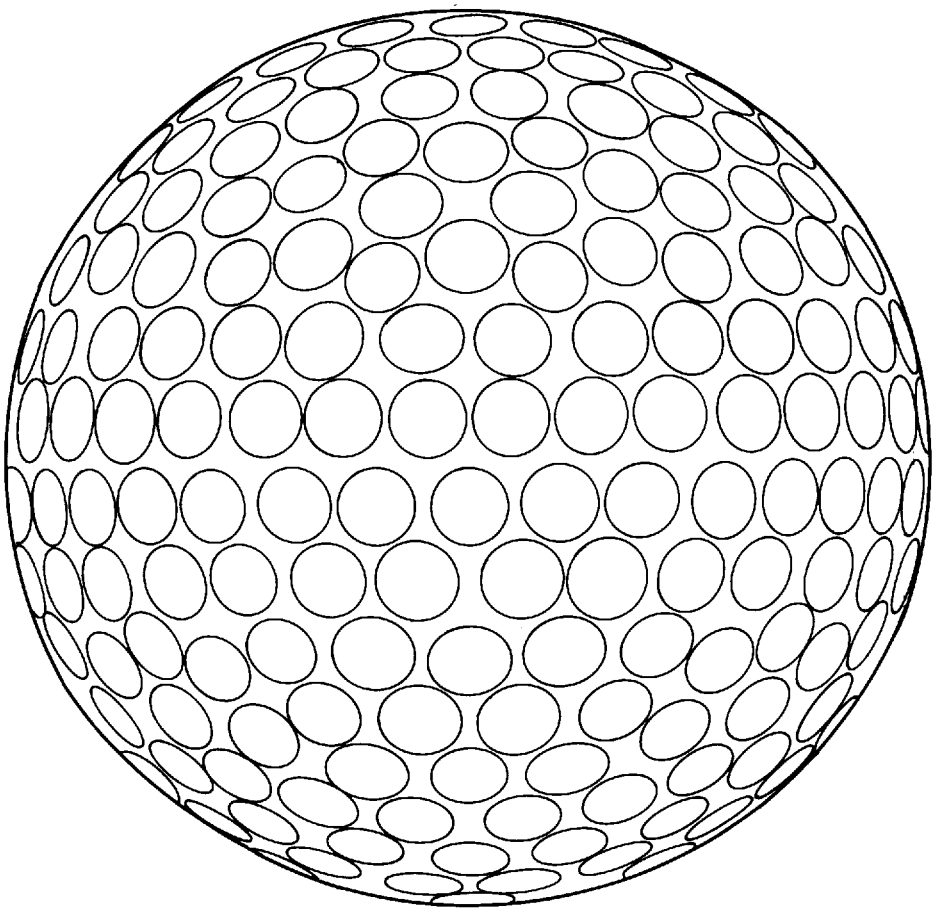
FIG. 10 is a front view of the third embodiment of dimple distribution.

| Dimple mode | Diameter (mm) | Depth (mm) | $V_0$ | Number | Diameter/ Depth | |
|---|---|---|---|---|---|---|
| | 3.220 | 0.142 | 0.485 | 60 | 22.7 | |
| | 2.365 | 0.112 | 0.492 | 36 | 21.1 | |
| B | 3.810 | 0.172 | 0.510 | 264 | 22.2 | FIGS. 7, 8 |
| | 3.190 | 0.144 | 0.510 | 120 | 22.2 | |
| | 2.340 | 0.105 | 0.510 | 48 | 22.3 | |
| C | 3.950 | 0.200 | 0.380 | 240 | 19.8 | FIGS. 9, 10 |
| | 3.100 | 0.200 | 0.380 | 120 | 15.5 | |

The golf balls were examined for fly, stop on the green, and feel by the following procedures.

Fly test

Using a swing robot manufactured by True Temper Co., the ball was hit by a driver at a head speed (HS) of 45 m/s and by an iron at a head speed of 35 m/s to measure the flying distance.

Stop on the green test

Using a swing robot manufactured by True Temper Co., the ball was hit by a pitching wedge at a head speed of 35 m/s so as to fly directly on the green. The distance between the landing and stop positions was measured. A negative value is the distance the ball covers due to back spin. A positive value is a run in a flying direction.

Feel test

In a sensory test, a player hit the ball at a head speed (HS) of 35 m/s. The ball feel was rated "very soft", "soft" or "hard".

TABLE 4

| | | Example | | | | | Comparative Example | | | | |
|---|---|---|---|---|---|---|---|---|---|---|---|
| | | 1 | 2 | 3 | 4 | 5 | 1 | 2 | 3 | 4 | 5 |
| Core distortion (mm) | | 2.95 | 3.30 | 3.60 | 3.90 | 3.95 | 2.60 | 3.00 | 2.90 | 3.00 | 4.00 |
| Ball distortion (mm) | | 2.72 | 3.07 | 3.08 | 3.68 | 3.40 | 2.35 | 2.65 | 2.08 | 2.50 | 3.50 |
| Core/ball distortion ratio | | 1.08 | 1.07 | 1.17 | 1.06 | 1.16 | 1.11 | 1.13 | 1.39 | 1.20 | 1.14 |
| Cover thickness (mm) | | 1.5 | 1.5 | 1.8 | 1.5 | 1.9 | 2 | 1.4 | 2.4 | 1.9 | 1.8 |
| Cover resin | | I | I | II | I | II | II | III | IV | IV | III |
| Cover hardness (Shore D) | | 56 | 56 | 57 | 56 | 57 | 57 | 60 | 65 | 65 | 60 |
| Dimple Mode | | A | A | B | B | A | C | C | B | B | C |
| Feel (HS35) | | soft | very soft | very soft | very soft | very soft | hard | soft | soft | soft | very soft |
| Flying distance (m) | HS 45 | 234 | 236.5 | 236 | 236 | 235.5 | 228 | 228.5 | 235 | 231 | 232.5 |
| | HS 35 | 159 | 159.5 | 160 | 162 | 161 | 147.5 | 151.5 | 157.5 | 158 | 157 |
| Stop on the green | Landing-to-stop distance (m) | −0.5 | 0 | 0 | 0 | 0.5 | 0 | 1.5 | 2.5 | 3 | 1.5 |

Although some preferred embodiments have been described, many modifications and variations may be made thereto in the light of the above teachings. It is therefore to be understood that within the scope of the appended claims, the invention may be practiced otherwise than as specifically described.

We claim:

1. A solid golf ball comprising a solid core and a cover having a plurality of dimples thereon wherein the core has a distortion of 2.8 to 4.0 mm under a load of 100 kg, the ratio of a core distortion (mm) under a load of 100 kg divided by a ball distortion (mm) under a load of 100 kg ranges from 1.0 to 1.3, the cover has a thickness of 1.4 to 1.9 mm, and a Shore D hardness of 53 to 60, said dimples are divided into at least three kinds of dimples which have different diameters each other, each dimple has the ratio of diameter (mm) divided by depth (mm) of 18 to 27, the value of the spatial volume of each dimple below a plane defined by an edge of the dimple divided by the volume of a cylinder wherein the bottom of said cylinder is defined by said plane and the height is determined by the maximum depth of the dimple from said plane ranges from 0.390 to 0.550, and the total number of said dimples is in the range of 390 to 450.

2. The golf ball of claim 1 wherein the number of the dimples having the largest diameter occupies at least 10% in the total number of all the dimples, and each dimple having the largest diameter has the ratio of diameter (mm) divided by depth (mm) of 22 to 26.

* * * * *